United States Patent [19]

Cornell

[11] 4,009,696

[45] Mar. 1, 1977

[54] HYDRAULIC LASH ADJUSTER WITH INTERNAL OIL PRESSURE CONTROL

[75] Inventor: Richard D. Cornell, Muskegon, Mich.

[73] Assignee: Sealed Power Corporation, Muskegon, Mich.

[22] Filed: Nov. 20, 1975

[21] Appl. No.: 633,668

[52] U.S. Cl. ..... 123/90.35; 123/90.43

[51] Int. Cl.[2] ..... F01L 1/18

[58] Field of Search ..... 184/6.9; 123/90.35, 123/90.55, 90.56, 90.57, 90.58, 90.59, 90.43

[56] References Cited

UNITED STATES PATENTS

| | | | |
|---|---|---|---|
| 2,964,027 | 12/1960 | Dadd | 123/90.35 |
| 3,153,404 | 10/1964 | Van Slooten | 123/90.43 |
| 3,177,857 | 4/1965 | Kuchen | 123/90.35 |
| 3,240,195 | 3/1966 | Sossna | 123/90.35 |
| 3,267,918 | 8/1966 | Ayres | 123/90.35 |
| 3,322,104 | 5/1967 | Abell | 123/90.35 |
| 3,385,274 | 5/1968 | Shunta | 123/90.35 |
| 3,448,730 | 6/1969 | Abell | 123/90.35 |
| 3,476,093 | 11/1969 | Line | 123/90.35 |
| 3,598,095 | 8/1971 | Ayres | 123/90.35 |
| 3,630,179 | 12/1971 | Dadd | 123/90.35 |
| 3,838,669 | 10/1974 | Dadd | 123/90.35 |

*Primary Examiner*—C. J. Husar
*Assistant Examiner*—Daniel J. O'Connor
*Attorney, Agent, or Firm*—Price, Heneveld, Huizenga & Cooper

[57] ABSTRACT

A hydraulic lash adjuster for use with an internal combustion engine having an overhead cam, includes a stationary body received within a cylinder head bore and a plunger reciprocal within the body. The plunger includes a central cavity defining an oil reservoir. A passage is formed through the lash adjuster body to place the oil reservoir in fluid communication with the lubrication system of the engine. A pair of metering lands are formed on the exterior of the lash adjuster body adjacent the oil inlet passage to reduce the pressure of the oil in the oil reservoir to prevent pump-up.

13 Claims, 2 Drawing Figures

HYDRAULIC LASH ADJUSTER WITH INTERNAL OIL PRESSURE CONTROL

BACKGROUND OF THE INVENTION

This invention relates to hydraulic lash adjusters for overhead cam, internal combustion engines, and more particularly, it concerns an arrangement for the control of the internal operating pressure of such hydraulic lash adjusters.

It is common practice in the internal combustion engine art to employ an overhead cam arrangement to increase engine speed and operating efficiency. An overhead camshaft design increases the efficiency of valve train operation since the cam lobes bear directly upon the rocker arms which actuate the intake and exhaust valves. Engine speed may be increased due to the reduction in reciprocating weight resulting from the removal of push rods employed with conventional valve train arrangements. In order to insure quiet operation as well as relatively long life, the tolerances between the various moving parts of an overhead camshaft-type arrangement must be kept within fairly exact ranges. Any increase in the lash between the cam lobes and the follower surfaces on the rocker arms will result in noisy engine operation as well as increased wear of the moving parts.

Hydraulic lash adjusters have increasingly been used to compensate for cam surface and rocker arm wear. Under certain operating conditions, it has been found that the hydraulic lash adjuster plunger may extend or pump-up thereby opening the engine valves and interrupting engine operation. This pump-up action may occur if the engine is run at a relatively high speed prior to proper warm-up when the engine oil is cold and viscous or this condition may occur if the oil pump relief valve malfunctions. In these situations, excessive engine oil pressure may be present causing the hydraulic lash adjuster plunger to extend or pump-up. In a typical engine, the normal lubricant pressure in the gallery or lubrication passages may be within the range of 50–75 psi. Under the abnormal conditions described above, the oil pressure may exceed 100 psi.

In a conventional push rod actuated valve trains, the rocker arm ratio between the engine valve, the rocker arm pivot point and the push rod will multiply the valve spring load and thereby resist hydraulic tappet pump-up. With overhead cam valve trains, however, the rocker arm ratio is reversed and in inherent resistance to pump-up is not present.

U.S. Pat. No. 3,838,669 to Morris V. Dadd entitled "HYDRAULIC LASH ADJUSTER", issued Oct. 1, 1974 is an example of a lash adjuster construction having provision for reducing the pressure of the oil or lubricant in the lash adjuster oil reservoir. By reducing the internal or operating oil pressure of the lash adjuster, extension or pump-up of the plunger during abnormal conditions is prevented. In this arrangement, a cup-like element positioned in the plunger cavity serves to reduce the pressure in the oil reservoir by forming a restricted passageway.

Although functioning to reduce the internal operating pressure to acceptable levels, certain manufacturing and production problems are inherent with this arrangement. For example, it is difficult to obtain the precise tolerances required between the cup-like element and the inner portions of the plunger. Further, since a separate element is employed, certain assembly problems are present.

Therefore, it can be seen that a need exists for a hydraulic lash adjuster including means for reducing the internal operating pressure below that of the engine gallery pressure and whereby the problems heretofore experienced may be substantially alleviated.

SUMMARY OF THE INVENTION

In accordance with the present invention, an improved hydraulic lash adjuster is provided which may be more easily manufactured at a reduced cost while being capable of more precise pressure control than heretofore possible. Essentially, the lash adjuster includes a body having a reciprocating plunger moving therein. The plunger includes a central cavity portion which defines an oil reservoir. Inlet ports are provided through the body and the plunger to thereby place the internal reservoir in fluid communication with the engine oil galleries. Pressure reduction means formed as part of the lash adjuster body function to reduce the oil pressure within the oil reservoir below that of the lubrication system operating pressure. The pressure reduction means permit controlled metering of lubricant from the gallery thereby reducing the pressure of the oil in the internal oil reservoir.

As a result of the structural arrangement of the present invention, lash adjuster pump-up is prevented during abnormal engine operating conditions. Since the pressure reduction means are formed as part of the lash adjuster body, there is no need for a separate component. This feature, therefore, reduces manufacturing costs, eliminates the assembly problems heretofore present and permits more precise control over the internal or operating oil pressure of the adjuster.

DETAILED DESCRIPTION OF THE PREFERRED EMBODIMENT

Figure 1:
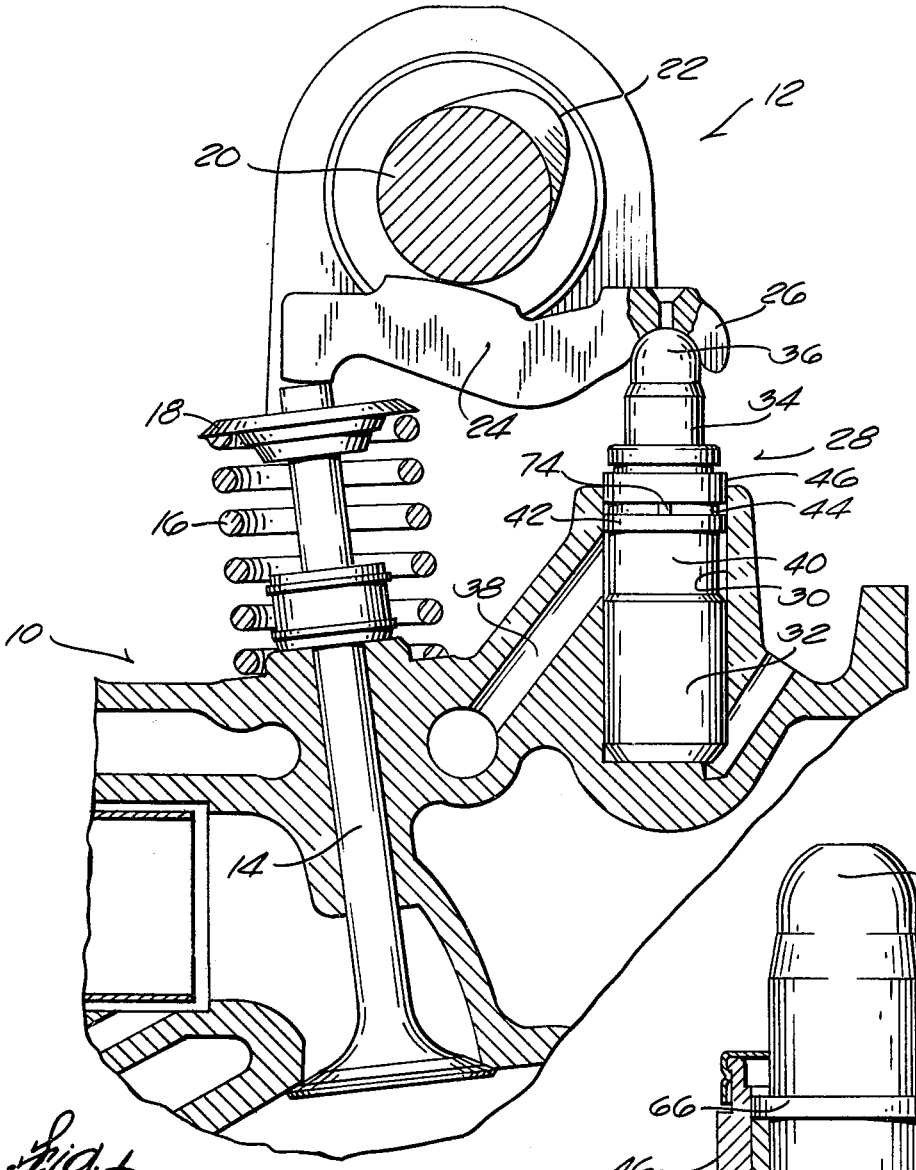
FIG. 1 is a fragmentary, cross-sectional, elevational view of an internal combustion engine employing an overhead cam and a hydraulic adjuster in accordance with the present invention.

Referring to FIG. 1 of the drawings, a portion of an overhead cam-type internal combustion engine including the cylinder head 10 is illustrated. Mounted on the cylinder head 10 is a valve train generally designated 12. The valve train 12 includes a plurality of valves 14 urged to the closed position by valve springs 16. The valve springs 16 act against valve spring retainers 18. Each valve 14 is opened and closed through an overhead cam arrangement including a camshaft 20 having cam lobes 22. The camming surfaces or lobes 22 act against a rocker arm 24. The rocker arm 24 includes a socket portion 26 at one end.

The hydraulic lash adjuster in accordance with the present invention is generally designated 28 and is received within a bore 30 formed in the cylinder head 10. The lash adjuster 28 includes a lash adjuster body 32 and a reciprocating plunger 34. The plunger 34 terminates in a spherical head or fulcrum ball 36. The fulcrum 36 is received in the socket portion 26 of the rocker arm 24.

Figure 2:
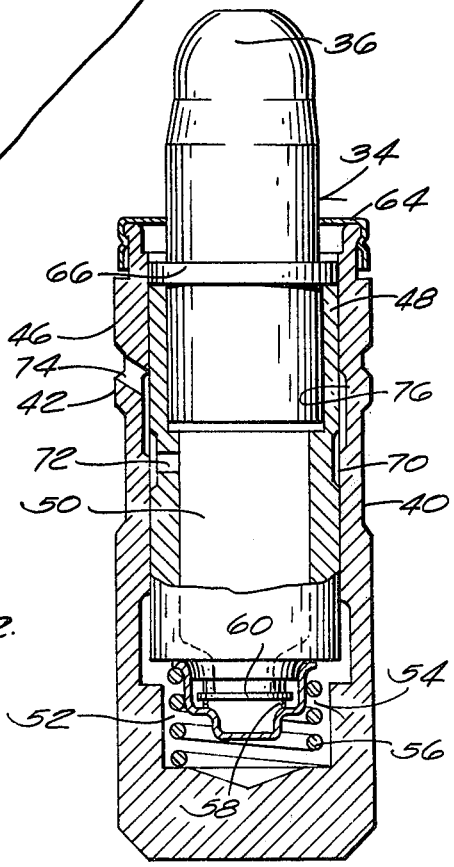
FIG. 2 is a cross-sectional, side elevational view of the hydraulic lash adjuster illustrated in FIG. 1.

The lubrication system of the internal combustion engine includes a conventional pump (not shown) for delivering oil under pressure to a gallery 38 formed in the cylinder head. The gallery 38 is in fluid communication with the cylinder head bore 30. As best seen in FIGS. 1 and 2, the adjuster body 32 is formed with a stepped, cylindrical exterior surface and includes a medially located, circumferential oil-receiving groove 40. The lower portion of the body 32 is dimensioned so as to fit snugly within the bore 30. A central land 42 is formed on the exterior surface of body 32 adjacent the oil-receiving groove 40. Above the central land 42, the body 32 is formed with an oil-collecting groove 44. Immediately above the oil-collecting groove 44, the body 32 is formed with an upper leakage land 46.

As best seen in FIG. 2, the plunger 34 is illustrated as being of two-part construction including a piston portion 48 and the closure element or fulcrum portion 36. The piston portion 48 is hollow and defines an oil reservoir or cavity 50. The cavity 50 opens into a lower compression chamber 52 through a check valve 54. A spring 56 biases the plunger assembly upwardly against the closed socket 26 of rocker arm 24. A spring 58 biases a valve plate 60 against the bottom of the piston 48. As shown, spring 58 is retained by a cap 62 which in turn is engaged by the spring 56. A crimped retainer collar 64 is positioned around the upper end of the adjuster body 32. In conjunction with a shoulder 66 formed on the closure or fulcrum 36, the collar 64 limits upward vertical movement of the plunger assembly 34. As is readily apparent, the plunger assembly 34 could be formed as a single piece, the choice of manufacturer being dependent upon the economies involved.

The piston 48 includes a medially formed circumferential groove 70 at which a single inlet port 72 is formed. The adjuster body 32 has an inlet port 74 formed therein at the oil collection groove 44. Further, a groove 76 is formed along the inner peripheral surface of the adjuster body to thereby place inlet port 74 in fluid communication with the port 72.

Central land 42 forms the primary pressure reduction means of the present hydraulic lash adjuster. The land is dimensioned so as to provide a restriction between the peripheral surface of the bore wall 30 and the outer peripheral surface of the land 42. The length of the land 42 and the degree of clearance determines the drop in pressure between the oil gallery and the collecting groove 44. The leakage land 46 also functions to determine the operating oil pressure and assists in collection of oil within the oil groove 44. By providing the leakage land 46, only a single inlet port 74 need be provided to insure an adequate supply of lubricant to the internal oil reservoir 50.

In operation, oil is delivered through the gallery 38 to the oil-receiving groove 40. The oil or lubricant will then pass upwardly around the entire periphery of the adjuster body 32 and be metered past the land 42, thereby reducing the pressure. The oil will then collect in the oil groove 44 and flow through the inlet ports 74 and 72 to the internal cavity. The land 46 is dimensioned so that controlled leakage will occur across it into the overhead drainage area of the cylinder head 10.

The actual location of the lands 42, 46, their lengths, as well as the amount of annular clearance between the lash adjuster and the adjuster bore 30 will vary according to the operating oil pressure found in each engine application. It is preferred, however, that the internal or operating pressure of the adjuster be approximately one-third to one-half of the gallery operating pressure. Such a pressure differential will insure sufficient oil pressure to permit operation without plunger pump-down due to oil starvation, and yet prevent plunger pump-up.

Various advantages flow from the present adjuster arrangement which have heretofore not been found. For example, the finish grind operation normally employed in machining an adjuster body permits more precise pressure control than can be obtained with a lash adjuster arrangement employing a separate pressure control element disposed within the interior of the piston or plunger assembly. Generally, due to the nature of machining operations employed, tolerances on the interior of the adjuster body and on the interior of the piston may not be as easily maintained as the tolerances obtainable by an exterior finish grind operation. Further, assembly problems are substantially alleviated since a separate component is not employed.

It should also be noted that the fulcrum portion 36 of the plunger assembly 34 is of solid, aperture-free construction. In the past, a central passage has been formed in the plunger and lubricant has been metered upwardly to the rocker arm socket 26. It has been found, however, that sufficient lubricant is present in the overhead cam housing to permit splash lubrication of the socket 26. All that need be provided is a chamfered opening in the rocker arm 24 at the socket portion 26.

It is, therefore, readily apparent that the hydraulic lash adjuster in accordance with the present invention is easily manufactured, capable of precise pressure control, and substantially alleviates the problems heretofore found in the prior art. As expressly intended, therefore, the foregoing description is illustrative of the preferred embodiment only. It is not to be considered limiting and the true spirit and scope of the present invention will be determined by reference to the appended claims.

The embodiments of the invention in which an exclusive property or privilege is claimed are defined as follows:

1. A hydraulic lash adjuster for use with an internal combustion engine of the type having an overhead cam, a rocker arm having a socket, a lubrication system and a bore formed in the engine cylinder head in communication with the lubrication system, comprising:

a lash adjuster body having a lower portion adapted to be disposed within said cylinder head bore, said body having a stepped cylindrical exterior surface;

a plunger reciprocal within said body and having a central cavity forming an oil reservoir, said plunger including a passage free fulcrum portion having a head receivable within the rocker arm socket;

means defining an oil inlet formed in said body and said plunger for placing said cavity in communication with said lubrication system; and pressure reduction means formed as a part of the lash adjuster body for reducing the oil pressure within the oil reservoir below that of the lubrication system operating pressure

2. A hydraulic lash adjuster as defined in claim 1, wherein said lash adjuster body has a reduced diameter portion intermediate the ends thereof defining an oil receiving groove in fluid communication with the engine lubrication system.

3. A hydraulic lash adjuster as defined by claim 2 wherein said pressure reduction means includes a land formed on the exterior surface of said body intermediate the oil receiving groove and the oil inlet means, said land extending around the entire circumference of said body and thereby metering oil from said oil receiving groove past said body.

4. A hydraulic lash adjuster as defined by claim 3 wherein said oil inlet means comprises said body having a reduced diameter portion defining an oil collection groove and said body at said oil collection groove having a passage in fluid communication with said plunger oil reservoir.

5. A hydraulic lash adjuster as defined by claim 4 wherein said pressure reduction means further includes another land formed on the exterior surface of said body between said oil collection groove and the upper end of said body, said another land being a leakage land permitting controlled leakage of the oil from said oil collection groove past said body upper end.

6. A hydraulic lash adjuster as defined by claim 5 wherein each of said lands is dimensioned so that the oil reservoir pressure is between ⅓ and ½ the lubrication system operating pressure.

7. A hydraulic lash adjuster as defined by claim 3 wherein the diameter of said body along said oil receiving groove is substantially equal to the diameter of said body along said oil collection groove.

8. A hydraulic lash adjuster as defined by claim 7 wherein said plunger has a passage formed therein in fluid communication with said body inlet passage thereby permitting passage of oil from said oil collecting groove to said central cavity.

9. A hydraulic lash adjuster as defined by claim 8 wherein said pressure reduction means further includes another circumferential land formed on and extending around the exterior surface of said body between said oil collection groove and the upper end of said body, said another land being a leakage land dimensioned to permit controlled leakage of oil from said oil collecting groove past the upper end of said body.

10. A hydraulic lash adjuster as defined by claim 9 wherein each of said lands is dimensioned so that the oil reservoir pressure is between ⅓ and ½ the lubrication system operating pressure.

11. A hydraulic lash adjuster for placement in an internal combustion engine cylinder head bore and in communication with an engine oil gallery comprising, in combination: a body; a plunger reciprocal within said body, said plunger having a central cavity forming an oil reservoir; a lubricating oil inlet means communicating with said central cavity; and a closure element forming the upper outer portion of said plunger, said body having a peripheral groove for alignment with the engine gallery, a second peripheral groove spaced from said first groove by a land, said second groove being in alignment with said oil inlet, and a second land spaced from said first land by said second groove, said second land being in close association with the engine cylinder bore to define a restricted oil flow passageway permitting restricted flow therethrough such that flow from the engine gallery into said second groove is diverted through said inlet into said reservoir and through said second land reducing the oil pressure within the oil reservoir below that of the lubrication system operating pressure.

12. A hydraulic lash adjuster as defined by claim 11 wherein said plunger is of one piece construction.

13. In an internal combustion engine of the type having a cylinder head, an overhead cam arrangement supported on the cylinder head for actuating the intake and exhaust valves, and a lubrication system, wherein the improvement comprises: said cylinder head having a cylindrical bore therein in fluid communication with said lubrication system; a hydraulic lash adjuster having a body disposed within said cylinder head bore and a plunger reciprocal within said body, said plunger having an oil reservoir and said body having an oil passage placing said reservoir in fluid communication with the engine lubrication system; said body further including a circumferential oil receiving groove and a circumferential oil collecting groove within which said oil passage opens; a first land on said body intermediate said oil receiving groove and said oil collecting groove thereby defining a first annular metering and pressure reducing clearance with said bore; and a second land on said body thereby defining a second annular leakage clearance with said bore, said oil collecting groove being intermediate said first land and said second land whereby the oil pressure within said oil reservoir is reduced by flow of oil through said lands and past the upper end of said body.

* * * * *

UNITED STATES PATENT AND TRADEMARK OFFICE

CERTIFICATE OF CORRECTION

PATENT NO. : 4,009,696

DATED : March 1, 1977

INVENTOR(S) : Richard D. Cornell

It is certified that error appears in the above-identified patent and that said Letters Patent are hereby corrected as shown below:

Column 1, line 44:

After "In" delete "a".

Column 1, line 50:

"in" should be --an--.

Column 2, line 40:

After "hydraulic" insert --lash--.

Column 4, line 61:

After "pressure" insert --by metering oil past said lash adjuster body within said bore.--

Signed and Sealed this

Twenty-first Day of June 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 4,009,696

DATED : March 1, 1977

INVENTOR(S) : Richard D. Cornell

It is certified that error appears in the above-identified patent and that said Letters Patent are hereby corrected as shown below:

Column 5, line 23:

"claim 3" should be --claim 4--.

Signed and Sealed this

*Twelfth* Day of *August 1980*

[SEAL]

*Attest:*

SIDNEY A. DIAMOND

*Attesting Officer*

*Commissioner of Patents and Trademarks*